US010309629B2

(12) United States Patent
Liang

(10) Patent No.: US 10,309,629 B2
(45) Date of Patent: Jun. 4, 2019

(54) ELASTICALLY-BUCKLED LAMP

(71) Applicant: LITEHARBOR LIGHTING TECHNOLOGY CO., LTD., Foshan (CN)

(72) Inventor: Bing Liang, Foshan (CN)

(73) Assignee: LiteHarbor Lighting Technology Co. Ltd, Foshan (CN)

( * ) Notice: Subject to any disclaimer, the term of this patent is extended or adjusted under 35 U.S.C. 154(b) by 27 days.

(21) Appl. No.: 15/643,421

(22) Filed: Jul. 6, 2017

(65) Prior Publication Data

US 2018/0172254 A1 Jun. 21, 2018

(30) Foreign Application Priority Data

Dec. 16, 2016 (CN) ..... 2016 2 1390701 U

(51) Int. Cl.
*F21V 21/08* (2006.01)
*F21V 21/02* (2006.01)
*F21V 21/14* (2006.01)

(52) U.S. Cl.
CPC ..... *F21V 21/14* (2013.01); *F21V 21/02* (2013.01); *F21V 21/0816* (2013.01)

(58) Field of Classification Search
CPC ..... F21V 21/14; F21V 21/02; F21V 21/145; F21V 21/34; F21V 21/00; F21V 21/08; F21V 21/0816; F21V 19/00; F21V 19/001; F21V 19/0015; F21V 19/003; F21V 19/0045; F21V 19/0055; F21V 19/004; F21V 17/00; F21V 17/02; F21V 17/06; F21V 17/10; F21V 17/104; F21V 17/12; F21V 17/18
USPC ..... 362/418
See application file for complete search history.

(56) References Cited

U.S. PATENT DOCUMENTS 6,176,594 B1 * 1/2001 Yarconi ..... F21V 19/0095 362/222
7,014,332 B2 * 3/2006 Sergio ..... F21S 8/04 362/147
8,356,920 B2 * 1/2013 Levine ..... F21S 8/00 362/249.03
2009/0098764 A1 * 4/2009 Janos ..... F21S 2/00 439/501

* cited by examiner

*Primary Examiner* — Bao Q Truong
(74) *Attorney, Agent, or Firm* — Inventa Capital PLC

(57) ABSTRACT

The present invention provides an elastically-buckled lamp, comprising a mounting base and a lamp body; there are more than three elastic buckles provided on the mounting base; arc-shaped grooves adapted to the elastic buckles are provided at an upper end of the lamp body, and the elastic buckles can be elastically deformed in a radial direction of the arc-shaped grooves and then inserted and clamped into the arc-shaped grooves; and when provided in the arc-shaped grooves, the elastic buckles are capable of sliding along the arc-shaped grooves to enable the lamp body to rotate relatively to the mounting base, so that it is easy to adjust mounting angles. Moreover, it is easy to mount and beautiful in appearance.

17 Claims, 3 Drawing Sheets

ELASTICALLY-BUCKLED LAMP

RELATED APPLICATION

The present application claims the benefit of the Chinese Patent Application CN201621390701.1 filed Dec. 16, 2016, which is incorporated herein by reference in its entirety.

FIELD OF THE INVENTION

The present invention relates to the field of lamps.

BACKGROUND OF THE INVENTION

A lamp configured to be fixedly mounted on a wall, a roof or a cabinet or in other positions usually includes a mounting base and a lamp body, and the lamp body is fixedly connected to the mounting base by screws and other connecting pieces at the center or edge. The lamp body fixed at the center should be dismounted during mounting the lamp, so that the process is time-consuming and laborious. For the lamp body fixed at the edge, a connector will be clamped outside the lamp body, thereby affecting the overall aesthetics of the product. Moreover, no matter it is fixed at the center or at the edge, the mounting positions of the lamp body cannot be adjusted after being mounted, but only can be adjusted by dismounting the lamp body for re-mounting, thus resulting in inconvenience in mounting.

OBJECTS AND SUMMARY OF THE INVENTION

In view of the defects in the prior art, the present invention provides an elastically-buckled lamp which is easy to adjust the position and is easy to mount and beautiful in appearance.

An elastically-buckled lamp is provided, including a mounting base and a lamp body; elastic buckles are provided on one of the mounting base and the lamp body, fixed grooves corresponding to the elastic buckles are provided on the other one of the mounting base and lamp body, and the elastic buckles can be inserted and clamped into the fixed grooves; and when provided in the fixed grooves, the elastic buckles are capable of sliding along the fixed grooves to enable the lamp body to slide relatively to the mounting base.

The mounting base can be fixed to the surface of a ceiling, a wall, a wardrobe or other objects in accordance with the specific requirements, the lamp body is close to the mounting base, the elastic buckles are aligned to the corresponding fixed grooves, and the lamp body is pushed to a direction of the mounting base, so that the elastic buckles are clamped in the fixed grooves, and it is easy to mount. Moreover, after being mounted, the elastic buckles are located inside the lamp, and the lamp has good integrity and beautiful appearance. When clamped in the fixed grooves, the elastic buckles are capable of sliding along the fixed grooves to enable the lamp body to slide relatively to the mounting base, so that the positions of the lamp body can be adjusted without dismounting the lamp.

Preferably, the fixed grooves are linear, and the one provided with the elastic buckles is capable of linearly sliding along the fixed grooves.

Preferably, the fixed grooves are arc-shaped, and the one of the mounting base and the lamp body provided with the elastic buckles is capable of rotating along the fixed grooves.

Further, there are more than three elastic buckles provided on the mounting base; the fixed grooves are provided on the lamp body and are arc-shaped grooves; the elastic buckles can be elastically deformed in a radial direction of the arc-shaped grooves and then inserted and clamped into the arc-shaped grooves; and when clamped in the arc-shaped grooves, the elastic buckles are capable of sliding along the arc-shaped grooves to enable the lamp body to rotate relatively to the mounting base.

Further, each of the elastic buckles includes a connecting bracket and a ball plunger provided on the connecting bracket, the connecting bracket is connected to the mounting base, and a ball of the ball plunger is capable of moving in a radial direction of the circumference. The ball plunger is also commonly referred to as an elastic collision bead.

Preferably, a plurality of elastic buckles are located on a same circumference.

More preferably, there are four elastic buckles, and the buckles are pairwise symmetrical around a center of the circumference.

Further, a recess for holding the mounting base is also provided at an upper end of the lamp body.

Preferably, the plurality of elastic buckles are distributed on a plurality of concentric circles, and at least two of the elastic buckles are provided on each circumference.

Preferably, there are a plurality of arc-shaped grooves arranged concentrically.

Preferably, the elastic buckle is a snap bulge which is formed by an elastic sheet and can be elastically deformed in a radial direction of the arc-shaped groove.

Further, the mounting base is circular.

Preferably, the lamp body includes a lampshade and a cover plate which is detachably provided at an upper end of the lampshade; and the arc-shaped grooves are provided on the cover plate.

Further, when the elastic buckles are clamped in the arc-shaped grooves, the ball of the ball plunger is clamped at a lower end of the cover plate.

Further, the lampshade includes a lamp frame and a light-transmitting plate provided at a lower end of the lamp frame and the cover plate is provided at an upper end of the lamp frame.

Further, the lampshade further includes a light guide plate and a diffusion plate which are provided at an upper end of the light-transmitting plate, and the diffusion plate is located between the light guide plate and the light-transmitting plate.

Further, a piece of reflector paper, which is unidirectionally transparent to light from the top down and can reflect light emitted thereto from below, is also provided on an upper surface of the light-transmitting plate.

Preferably, the light-transmitting plate is a glass plate.

Preferably, a circuit board, having a light source provided thereon, is provided on a lower surface of the cover plate.

Further, a photomask is provided on the lower surface of the cover plate.

Further, a wire rope configured to connect to the ceiling is provided on the circuit board.

Preferably, the light source is an LED lamp.

Further, a light source plate is also provided on an inner side of the lamp frame.

BRIEF DESCRIPTION OF FIGURES

In order to more clearly illustrate the specific embodiments of the present invention or the technical solutions in the prior art, the specific embodiments or the drawings used in the description of the prior art will be briefly described below. In all the drawings, similar components or parts are generally identified by similar marks of the drawings. In the drawings, the components or parts are not necessarily drawn according to the actual proportions.

REFERENCE NUMERALS IN THE DRAWINGS

Figure 1:
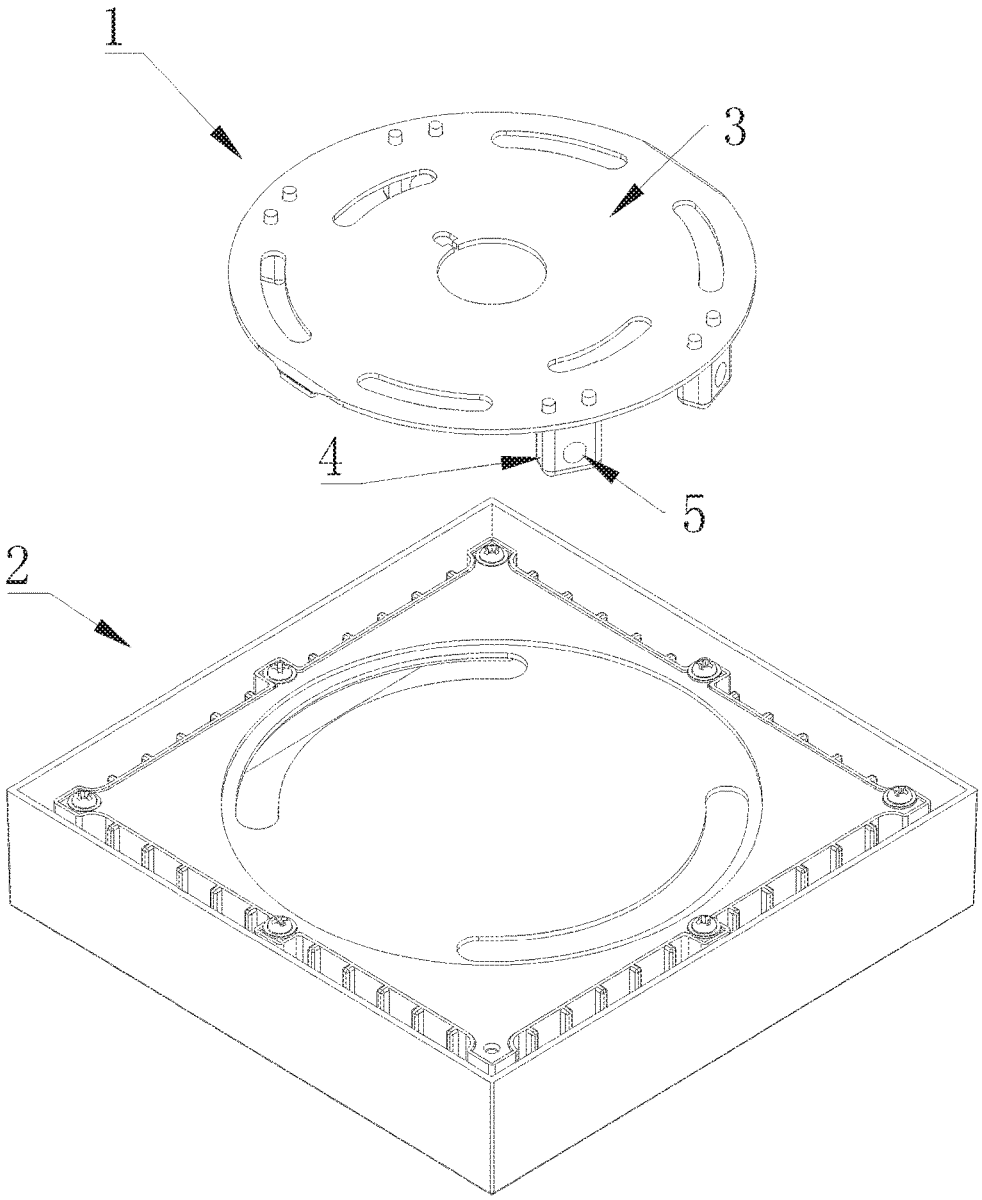
FIG. 1 is a structural diagram of an elastically-buckled lamp provided by an embodiment according to the present invention.

1: Mounting base
2: Lamp body
3: Ceiling plate
4: Connecting bracket
5: Ball
6: Cover plate
7: Arc-shaped groove
8: Recess
9: Lamp frame
10: Light-transmitting plate
11: Light guide plate
12: Diffusion plate
13: Reflector paper

DETAILED DESCRIPTION OF THE EMBODIMENTS

Embodiments of the technical solution of the present invention will be described in detail as below with reference to the accompanying drawings. The following embodiments are merely used for describing the technical solution of the present invention more clearly. Therefore, the embodiments are merely used as examples, but not as limitation to the protection range of the present invention.

It should be noted that, unless otherwise specified, the technical terms and scientific terms used in this application should be of ordinary meaning to those skilled in the field to which this invention belongs.

Figure 2:
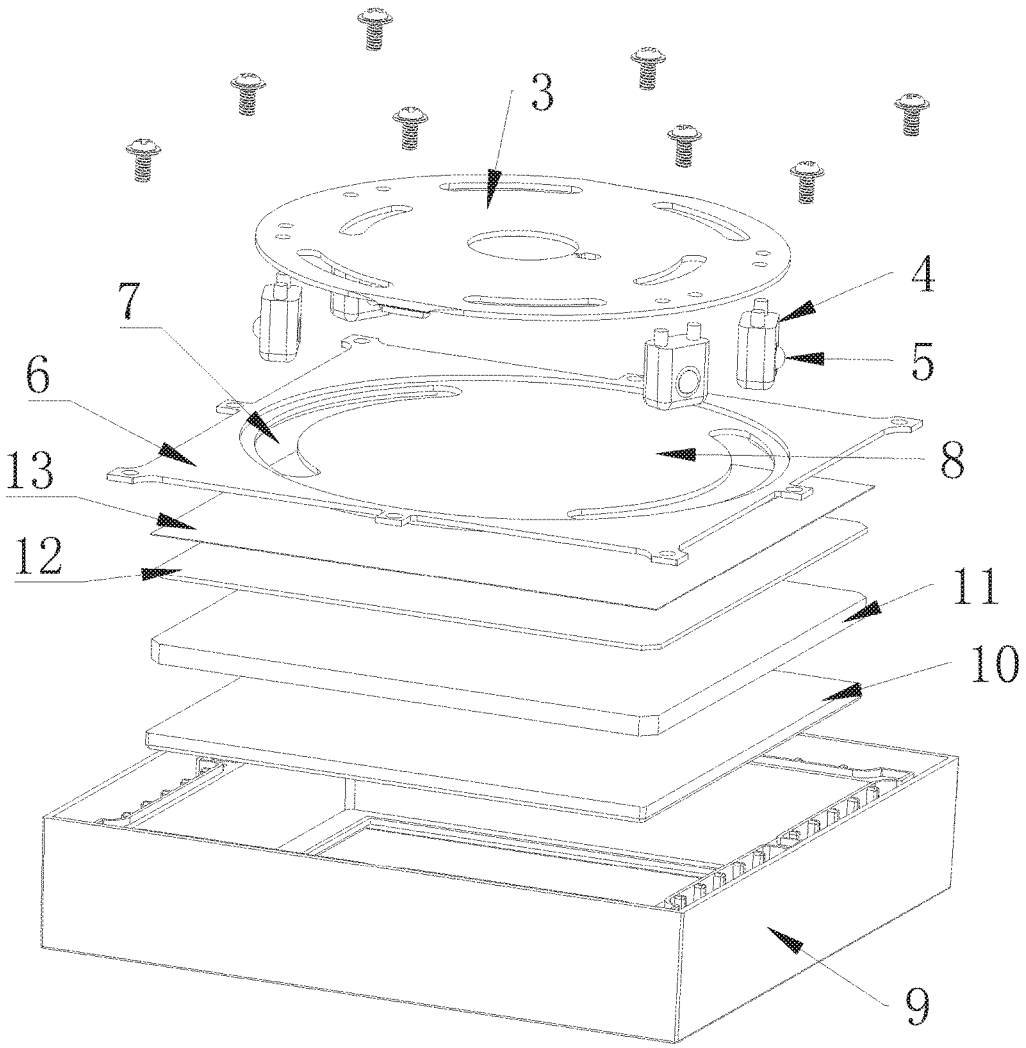
FIG. 2 is an exploded view of the elastically-buckled lamp in FIG. 1.
Figure 3:
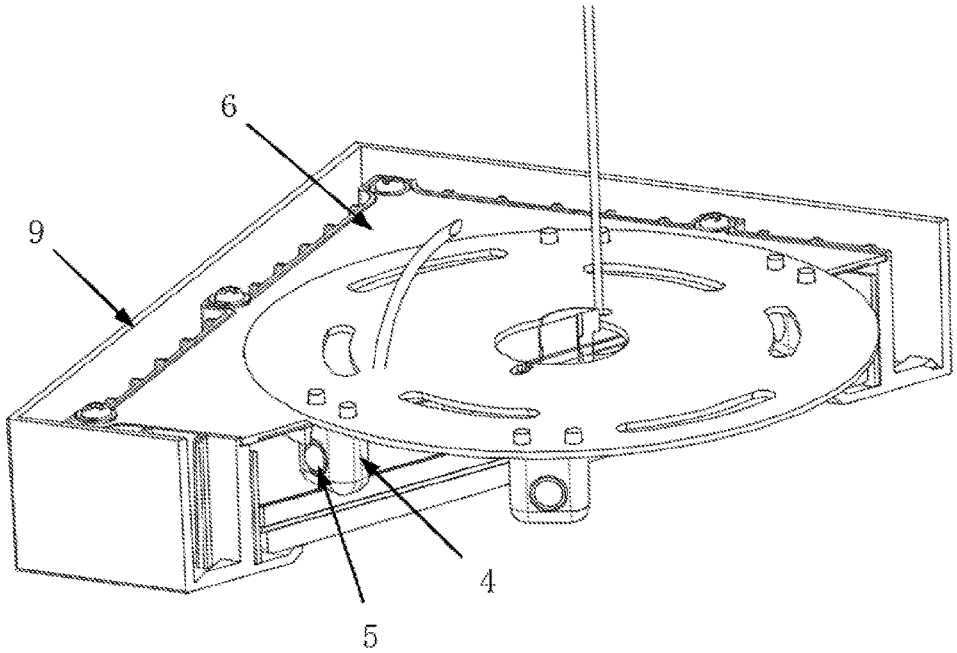
FIG. 3 is a part sectioned view of the elastically-buckled lamp in an embodiment.

With reference to FIG. 1 to FIG. 3, in an embodiment, an elastically-buckled lamp is provided, including a mounting base 1 and a lamp body 2. The mounting base 1 includes a ceiling plate 3 mounted on a ceiling, and elastic buckles. There are more than three elastic buckles provided on a lower surface of the ceiling plate 3. Fixed grooves adapted to the elastic buckles are provided at an upper end of the lamp body 2. In the embodiment, the fixed grooves are arc-shaped grooves 7, and the elastic buckles can be elastically deformed in a radial direction of the arc-shaped grooves 7 and then inserted and clamped into the arc-shaped grooves 7. When the elastic buckles are clamped in the arc-shaped grooves 7, the lamp body 2 can rotate relatively to the ceiling plate 3 to enable the elastic buckles to slide along the arc-shaped grooves 7.

During mounting, the mounting base 1 is fixed on the ceiling, the lamp body 2 is close to the mounting base 1, the elastic buckles are aligned to the corresponding arc-shaped grooves 7, and the lamp body 2 is pushed to a direction of the mounting base 1, so that the elastic buckles are clamped in the arc-shaped grooves 7, and it is easy to mount. Moreover, after being mounted, the elastic buckles are located inside the lamp, and the lamp has good integrity and beautiful appearance. The arc-shaped grooves 7 can be circular or can be a plurality of circular arcs arranged concentrically, so that the lamp body 2 is capable of rotating relatively to the mounting base 1. Specifically, when the lamp body 2 rotates, the elastic buckles slide in the corresponding arc-shaped grooves 7. Therefore, it can be easy to adjust mounting angles of the lamp body 2 relative to the mounting base 1 without dismounting the lamp.

In other embodiments, the arc-shaped grooves can be further provided on the mounting base, the lamp body is provided with the corresponding elastic buckles, and the fixed grooves are not limited to an arc shape, but may be a linear type, a curved shape or the like.

In the embodiment, the ceiling plate 3 is circular, and the lamp body 2 includes a lampshade and a cover plate 6 which is detachably provided at an upper end of the lampshade. The arc-shaped grooves 7 are provided on the cover plate 6. It should be understood that the shape of the ceiling plate 3 may also be other forms such as square, polygon and irregular shape.

Each of the elastic buckles includes a connecting bracket 4 and a ball 5 plunger provided on the connecting bracket 4, the connecting bracket 4 is connected to the ceiling plate 3, and a ball 5 of the ball 5 plunger is capable of moving in a radial direction of the circumference. The ball 5 plunger is also commonly referred to as an elastic collision bead. After being pressed, the ball 5 can retract into the plunger. When mounting the lamp body, the ball 5 collides with an opening of the arc-shaped grooves 7 and retracts into the plunger. When the ball 5 reaches a lower end of the cover plate 6, the ball 5 extends out to clamp the elastic buckles in the arc-shaped grooves 7.

Preferably, there are four elastic buckles configured to fix the lamp body 2 jointly to prevent the lamp body 2 dropping, and each two of the four elastic buckles are symmetrical around a center of the circumference. Further, the four elastic buckles are provided on a same circumference. Two arc-shaped grooves 7 located on a same circumference are provided on the cover plate 6, and two elastic buckles are fitted within each of the arc-shaped grooves 7. The arc-shaped grooves 7 on the cover plate 6 can be machined by stamping, and a connecting plate for connecting an inner circle and an outer circle is formed between the two arc-shaped grooves 7, and the process is simple.

It should be understood that the protection scope of the present invention is not limited to four elastic buckles, and the elastic buckles can also be set as three, five or six or more according to the size and weight of the lamp body 2. Preferably, in order to make an acting point of the elastic buckles on the lamp body 2 more uniform when the lamp body 2 is large, the elastic buckles can be arranged on a plurality of concentric circles, and at least two buckles are provided on each concentric circle so that the lamp body 2 is stressed uniformly in a radial direction. When the elastic buckles are provided on the plurality of concentric circles, correspondingly, the arc-shaped grooves 7 are also located on the plurality of concentric circles.

Further, a recess 8 for holding the ceiling plate 3 is also provided at an upper end of the cover plate 6. When mounting the lamp body, the recess 8 plays a role of guiding the lamp body so that a center of the arc-shaped groove on the lamp body coincides with a central point of the plurality of elastic buckles on the mounting base. Meanwhile, when the lamp body is provided on the ceiling plate 3, the ceiling plate 3 is located in the recess 8 so that an edge of the cover plate 6 can be fitted to the ceiling to ensure the integrity and aesthetics of the lamp.

Specifically, in the embodiment, the lampshade includes a lamp frame 9 and a light-transmitting plate 10 provided at a lower end of the lamp frame 9 and the cover plate 6 is provided at an upper end of the lamp frame so as to form a holding cavity in the lamp frame 9, The light source in the holding cavity emits the illuminating light through the light-transmitting plate 10 outwardly. Preferably, the light-transmitting plate 10 is a glass plate, and the light source is an LED lamp.

In order to improve the lighting effect, the lampshade further includes a light guide plate 11 and a diffusion plate 12 which are provided at an upper end of the light-transmitting plate 10, and the diffusion plate 12 is located between the light guide plate 11 and the light-transmitting plate 10. The light guide plate 11 converts the line source emitted from the light source into an area source so that the light is even and soft, and the diffusion plate 12 realizes that the incident light is sufficiently scattered to produce an optical diffusion effect.

Further, a piece of reflector paper 13, which is unidirectionally transparent to light from the top down and can reflect light emitted thereto from below, is also provided on an upper surface of the light-transmitting plate 10, so that the upward scattered light is reflected into the light-transmitting plate 10 to improve the lighting effect.

In the embodiment, the circuit board is provided on a lower surface of the cover plate 6, and a patch of the LED lamp is provided on the circuit board, and a light source plate is further provided inside the lamp frame 9. A photomask is provided on the lower surface of the cover plate 6 to prevent light escaping from the upper end of the cover plate 6.

In order to prevent the elastic buckles from being detached from the arc-shaped grooves 7 to result in that the lamp body 2 is dropped, the circuit board is provided with a wire rope which is connected to the ceiling 6 by passing through the cover plate 6 so as to prevent the lamp body 2 from dropping when an emergency occurs, thus resulting in potential safety hazard.

In other embodiments, the elastic buckle can also be a snap bulge which is formed by an elastic sheet and can be elastically deformed in a radial direction of the arc-shaped groove. One end of the snap bulge facing the lamp is wedge-shaped, and a bevel transition is formed between upper and lower ends of the snap bulge, so that the snap bulge can be inserted and clamped into the arc-shaped groove.

It should be understood that, in other embodiments, the mounting base may also be a base fixed to a position such as a wall or a cabinet, thereby forming lamps of different type.

In the description of the present application, it should be understood that the positions or positional relationship indicated by the terms "upper", "lower", "front", "rear", "left", "right", "horizontal", "inside", "outside" and the like are positions or positional relationship as shown in the drawings, which are merely used for facilitating the description of the present invention, but not for indicating or implying that the devices or elements must have specific positions and must be construed and operated by the specific positions. Therefore, it should not be understood as a limitation to the present invention.

In addition, the terms "first", "second" and the like are merely used for descriptive purposes, but should not be understood as indicating or implying the number of technical features which are relatively important or implicitly indicated. In the description of the present invention, unless otherwise specifically defined, the "a plurality of" means two or more.

The specification of the present invention illustrates a large number of specific details. However, it can be understood that the embodiments of the present invention can be implemented without such specific details. In some examples, the well-known methods, structures, and techniques are not shown in detail so as not to obscure the understanding of the specification.

In the description of this specification, specific characteristics, structures, materials, or features may be combined in any or more embodiments or examples in an appropriate manner. In addition, in case of no mutual contradiction, a person skilled in the field can combine and assemble the various embodiments or examples as well as the characteristics of different embodiments or examples described in this specification.

Finally, it should be noted that the above embodiments are merely used for illustrating the technical solution of the present invention, but not for limiting thereto. In spite of a detailed description of the present invention with reference to the above embodiments, an ordinary person skilled in the field should understand that: this person may still make modifications to the technical solution recorded in the above embodiments, or make replacements to some or all of its technical characteristics. However, these modifications or replacements, which do not make the essence of the corresponding technical solution depart from the scope of the technical solution of the embodiments of the present invention, shall fall into the scope of the claims and the specification of the present invention.

What is claimed is:

1. An elastically-buckled lamp, comprising:

a mounting base; and a lamp body, wherein:

elastic buckles are provided on one of the mounting base and the lamp body;

fixed grooves corresponding to the elastic buckles are provided on the other one of the mounting base and the lamp body;

the elastic buckles can be inserted and clamped into the fixed grooves;

when provided in the fixed grooves, the elastic buckles are capable of sliding along the fixed grooves to enable the lamp body to slide relatively to the mounting base;

there are more than three elastic buckles provided on the mounting base;

the fixed grooves are provided on the lamp body and are arc-shaped grooves; the elastic buckles can be elastically deformed in a radial direction of the arc-shaped grooves and then inserted and clamped into the arc-shaped grooves;

when clamped in the arc-shaped grooves, the elastic buckles are capable of sliding along the arc-shaped grooves to enable the lamp body to rotate relatively to the mounting base;

the fixed grooves are arc-shaped;

the one of the mounting base and the lamp body provided with the elastic buckles is capable of rotating along the fixed grooves;

each of the elastic buckles includes a connecting bracket and a ball plunger provided on the connecting bracket;

the connecting bracket is connected to the mounting base; and a ball of the ball plunger is capable of moving in a radial direction of the arc-shaped grooves.

2. The elastically-buckled lamp in claim 1, wherein:

the fixed grooves are linear; and the one of the mounting base and the lamp body provided with the elastic buckles is capable of linearly sliding along the fixed grooves.

3. The elastically-buckled lamp in claim 2, wherein a plurality of elastic buckles are located on a same circumference.

4. The elastically-buckled lamp in claim 3, wherein:

there are four elastic buckles; and the buckles are pairwise symmetrical around a center of the circumference.

5. The elastically-buckled lamp in claim 2, wherein a recess for holding the mounting base is also provided at an upper end of the lamp body.

6. The elastically-buckled lamp in claim 2, wherein:

the plurality of elastic buckles are distributed on a plurality of concentric circles; and at least two of the elastic buckles are provided on a circumference of each concentric circle.

7. The elastically-buckled lamp in claim 2, wherein there are a plurality of arc-shaped grooves arranged concentrically.

8. The elastically-buckled lamp in claim 2, wherein the elastic buckle is a snap bulge which is formed by an elastic sheet and can be elastically deformed in a radial direction of the arc-shaped groove.

9. The elastically-buckled lamp in claim 2, wherein the mounting base is circular.

10. The elastically-buckled lamp in claim 2, wherein:

the lamp body includes a lampshade and a cover plate which is detachably provided at an upper end of the lampshade; and the arc-shaped grooves are provided on the cover plate.

11. The elastically-buckled lamp in claim 10, wherein:

when the elastic buckles are clamped in the arc-shaped grooves; and the ball of the ball plunger is clamped at a lower end of the cover plate.

12. The elastically-buckled lamp in claim 11, wherein:

the lampshade includes a lamp frame and a light-transmitting plate provided at a lower end of the lamp frame; and the cover plate is provided at an upper end of the lamp frame.

13. The elastically-buckled lamp in claim 12, wherein:

the lampshade further includes a light guide plate;

a diffusion plate which are provided at an upper end of the light-transmitting plate; and the diffusion plate is located between the light guide plate and the light-transmitting plate.

14. The elastically-buckled lamp in claim 13, wherein a piece of reflector paper, which is unidirectionally transparent to light from the top down and can reflect light emitted thereto from below, is also provided on an upper surface of the light-transmitting plate.

15. The elastically-buckled lamp in claim 12, wherein the light-transmitting plate is a glass plate.

16. The elastically-buckled lamp in claim 10, wherein a circuit board, having a light source provided thereon, is provided on a lower surface of the cover plate.

17. The elastically-buckled lamp in claim 16, wherein a photomask is provided on the lower surface of the cover plate.

* * * * *